US006053202A

United States Patent [19]

Cunningham

[11] Patent Number: 6,053,202

[45] Date of Patent: Apr. 25, 2000

[54] FAIL-SAFE CLOSURE SYSTEM FOR REMOTELY OPERABLE VALVE ACTUATOR

[75] Inventor: Christopher E. Cunningham, Spring, Tex.

[73] Assignee: FMC Corporation, Chicago, Ill.

[21] Appl. No.: 09/102,960

[22] Filed: Jun. 23, 1998

Related U.S. Application Data

[60] Provisional application No. 60/056,809, Aug. 22, 1997.

[51] Int. Cl.[7] ..... F16K 31/12

[52] U.S. Cl. ..... 137/596.16; 251/26; 60/404; 91/461

[58] Field of Search ..... 251/26, 25; 137/596, 137/596.14, 596.17, 596.16; 60/404; 91/461

[56] References Cited

U.S. PATENT DOCUMENTS 4,065,094 12/1977 Adams ..... 251/26

4,621,496 11/1986 Lamb .

4,809,586 3/1989 Gage et al. .

*Primary Examiner*—Kevin Lee

*Attorney, Agent, or Firm*—Gary L. Bush; Mayor, Day, Caldwell & Keeton, L.L.P.

[57] ABSTRACT

A fail-safe closure system for one or a plurality of springless process valve actuators is disclosed. An accumulator is provided with an urging means, such as a spring for pressurizing fluid stored therein. A source of pressurized fluid is also provided. Supply pressurized fluid is applied to an opening chamber of one or a plurality of process valve actuators while a flow path is opened to a vent from the closing chamber of the one or more actuators. For closing the actuator or actuators, a flow path is established by which pressurized fluid from the accumulator is applied to the closing chamber of the actuator or actuators while the opening chamber is vented. Control valves are arranged so that if or when they fail, they fail in a position which allows the process valve actuators to close as described.

16 Claims, 3 Drawing Sheets

FIG. 1
(PRIOR ART)
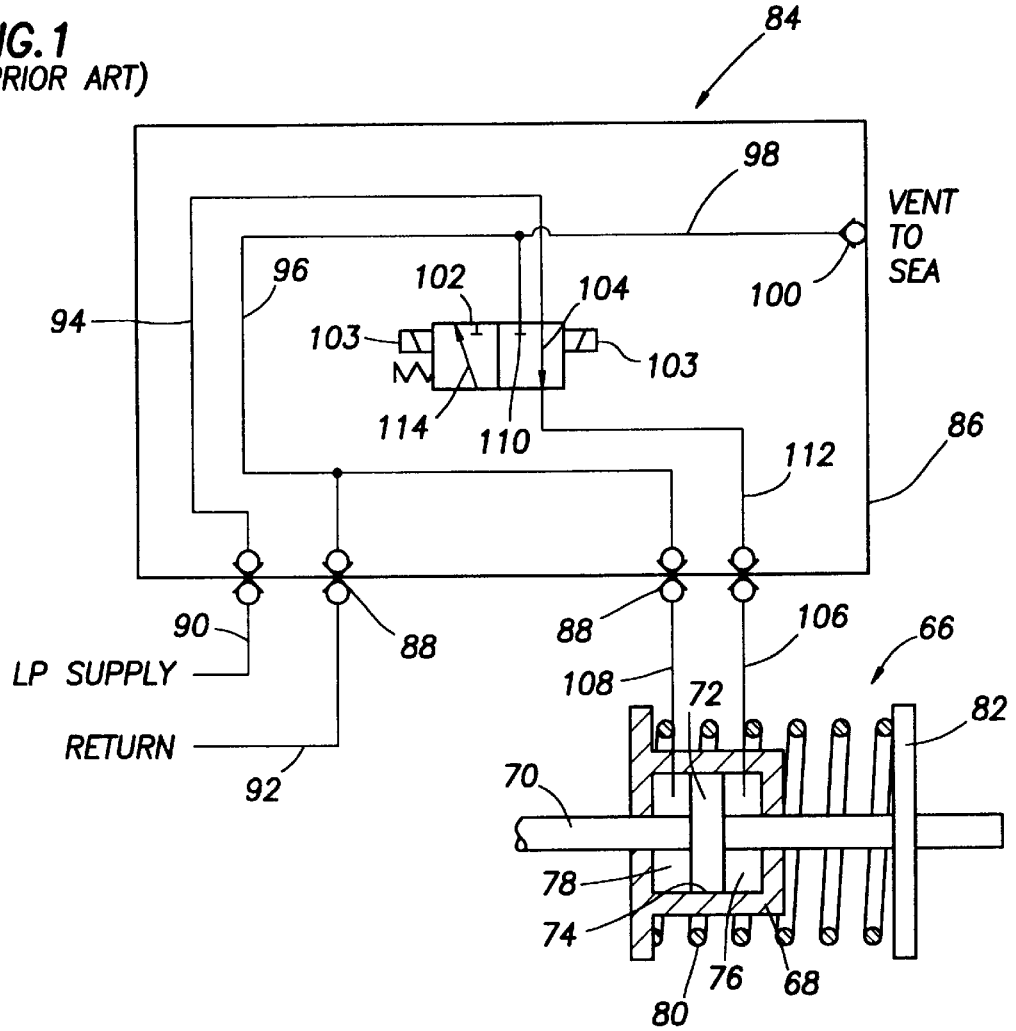
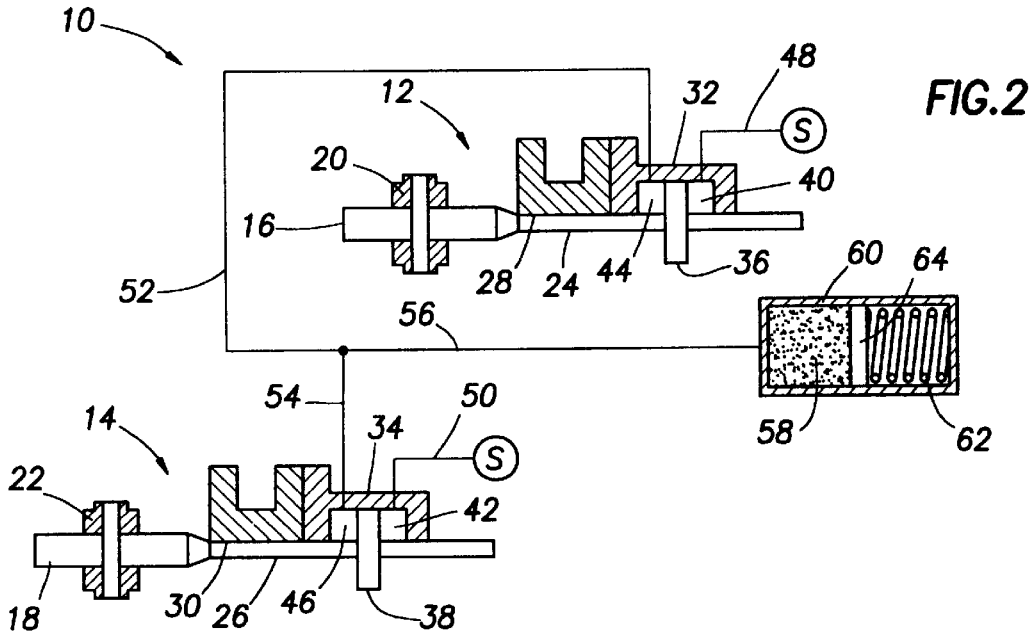
FIG. 2

FIG.3
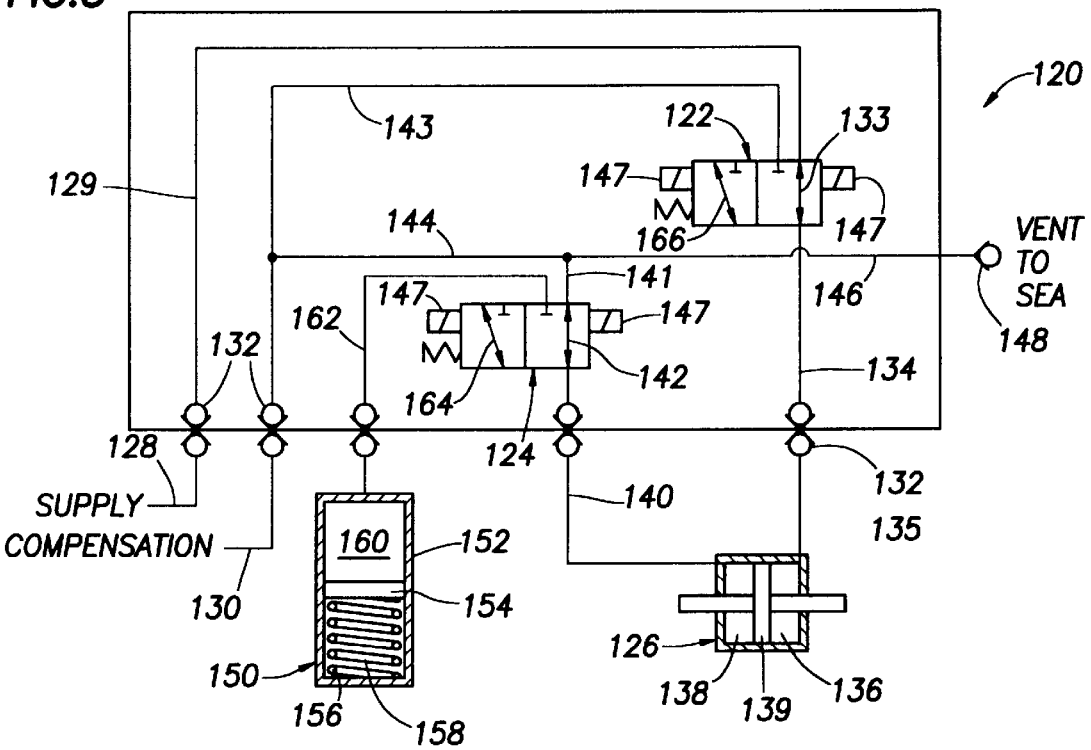
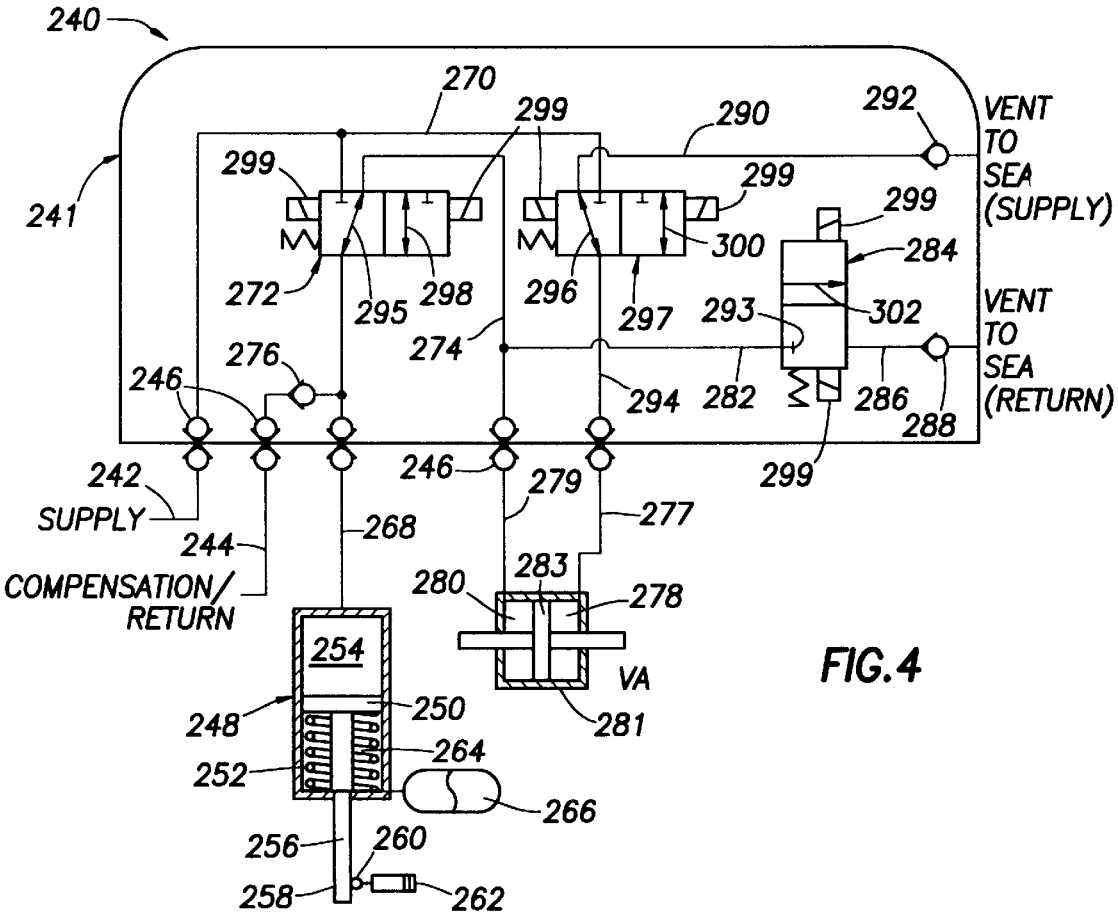
FIG.4

FAIL-SAFE CLOSURE SYSTEM FOR REMOTELY OPERABLE VALVE ACTUATOR

REFERENCE TO RELATED APPLICATION

This application claims the priority of provisional application Ser. No. 60/056,809 filed Aug. 22, 1997.

BACKGROUND OF THE INVENTION

1. Field of the Invention

This invention relates generally to valve actuators having "biased to safety position" closure systems, and more specifically, concerns fluid operated and fluid returned valve actuators with a single pressurized fluid source being controllably utilized to return one or a plurality of valves to the "safe" position thereof responsive to a predetermined control sequence.

2. Description of the Prior Art

Valve and valve actuator mechanisms that are designed for "fail-safe" operation of, for example, gate valves, typically comprise a valve operating stem for moving a gate member linearly between its open and closed positions within a valve body. The valve operator stem extends through a cylinder with a piston connected to the actuator stem being linearly moveable within the cylinder by a pressurized fluid medium such as fluid entering the cylinder on the supply side of the piston. The term "fluid" as used in the specification and claims is intended to include a hydraulic fluid and a compressible gas fluid. Actuating fluid from the return side of the piston is typically exhausted to a storage receptacle or accumulator (alternatively to the sea for subsea applications) as the piston is driven by the pressure of fluid on its supply side. As the piston is being moved by supply pressure, thus typically opening the valve, a preloaded compression spring acting on the actuator stem and opposing the force of supply pressure is further compressed as the actuator piston is moved by supply pressure.

For fail-safe closure of the valve, the pressure of the supply fluid is vented to dissipate the pressure-induced valve opening force on the actuator stem, thus allowing the force of the compression spring to drive the actuator stem outward in relation to the valve body, thus moving the gate of the valve mechanism to its closed position. Notably, valve body pressure acting on the stem typically assists the spring in moving the valve gate to its "safe" position (i.e., "closed" in the foregoing discussion). To accomplish this purpose, what was "supply" fluid during the valve opening operation must be exhausted from the supply side of the piston to accommodate the spring/pressure induced valve closing function. The "supply" fluid must either be moved in a reverse flow direction within the supply line or it may be vented by appropriate control as the "return" fluid is drawn in from a storage accumulator or other source. In the alternative, and being the preferred the "supply" fluid can be routed via a control valve to the return side of the piston, coincidentally displacing "supply" fluid and replacing "return" fluid. An accumulator is needed if the volumes of the supply and return sides of the actuator are different. Systems similar to those described above are typically also used for operation of other types of valves (e.g., ball, plug, butterfly, etc.).

Currently available spring-returned valve actuator mechanisms, especially those designed for deep water submerged applications, incorporate return springs that are very large, and require that even larger "valve actuator housings" be provided to protect them. The resulting fail-safe actuators are therefore large and heavy, are consequently quite costly, and result in correspondingly large and expensive systems built up using these components. It is desirable, therefore, to provide a method and apparatus for "fail-safe" valve closure for subsea and other valves that does not require that each valve actuator be equipped with a return dedicated spring. It is also desirable to provide a system incorporating multiple fail-safe valve and valve actuator assemblies wherein a single fluid pressure source is available for selective closure of one or more or all of the valve mechanisms in a system responsive to a predetermined condition or responsive to selective control.

SUMMARY OF THE INVENTION

The present invention is embodied in a fail-safe closure system for remotely operable valve and substantially springless actuator assemblies in a single fluid accumulator is used to return one or more valves to a safe position. Each valve and actuator assembly includes a valve actuator and a control valve therefor for controlling the movement of the associated process valve. The associated process valve or valves may, for example, comprise gate valve members. The fluid accumulator comprises a cylinder having a piston and a spring to urge the piston in one direction for pressurizing the fluid within the cylinder. The spring may be a compressible gas spring or a mechanical spring. Each actuator has a piston with a fluid chamber on opposite sides of the actuator piston defining a fluid supply chamber on one side of the actuator chamber and a fluid return chamber on the other side of the actuator chamber. Fluid from the accumulator is provided to the fluid return chambers for movement of the associated process valve member to a desired (typically closed) safe position. A charging valve is provided to recharge the fluid accumulator upon an exhaust of fluid from the fluid accumulator.

A releasable locking means retains the accumulator piston in a spring-loaded position so that the fluid in the accumulator will not influence operation of the valve actuators until specifically called upon to do so. Also, a fluid storage accumulator in fluid communication with the spring chamber of the accumulator compensates for volumetric differences in the internal chambers of the accumulator and balances the chambers for ambient conditions at substantial sea depths. The utilization of a single fluid accumulator particularly for a plurality of valve and actuator assemblies for return of an actuator piston to a fail-safe permits the utilization of valve actuators without the requirement of a mechanical return spring for each actuator.

BRIEF DESCRIPTION OF THE DRAWINGS

The various objects and advantages of this invention will become apparent to those skilled in the art upon an understanding of the following detailed description of the prior art and the invention, read in light of the accompanying drawings which are made a part of this specification and in which:

FIG. 1 illustrates a prior art system with a conventional fluid pressure operated, spring-returned valve actuator mechanism having the operating and fail-safe positions thereof enabled by positioning of a control valve;

FIG. 2 is a schematic for the subject invention illustrating multiple fluid or pneumatic pressure operated and returned valves actuated by independent pressure sources but connected to a common source for fluid pressure return of the valves to their respective closed positions;

FIG. 3 is a schematic for one embodiment of the present invention illustrating a control circuit for the arrangement in FIG. 2, specifically showing a fluid operated, fluid returned valve actuator mechanism having two control valves for controlling the fluid pressure closing force supply and fluid return compensation using an accumulator module;

FIG. 4 is a schematic for another embodiment of the invention illustrating another control circuit for the arrangement in FIG. 2 specifically showing a fluid and fluid returned valve actuator mechanism with the supply and return functions being responsive to positioning of control valves and with an accumulator module in the return conduit for returning the valve actuator to its process valve "safe" position.

DESCRIPTION OF PRIOR ART SYSTEMS

Prior Art System of FIG. 1

Figure 5:
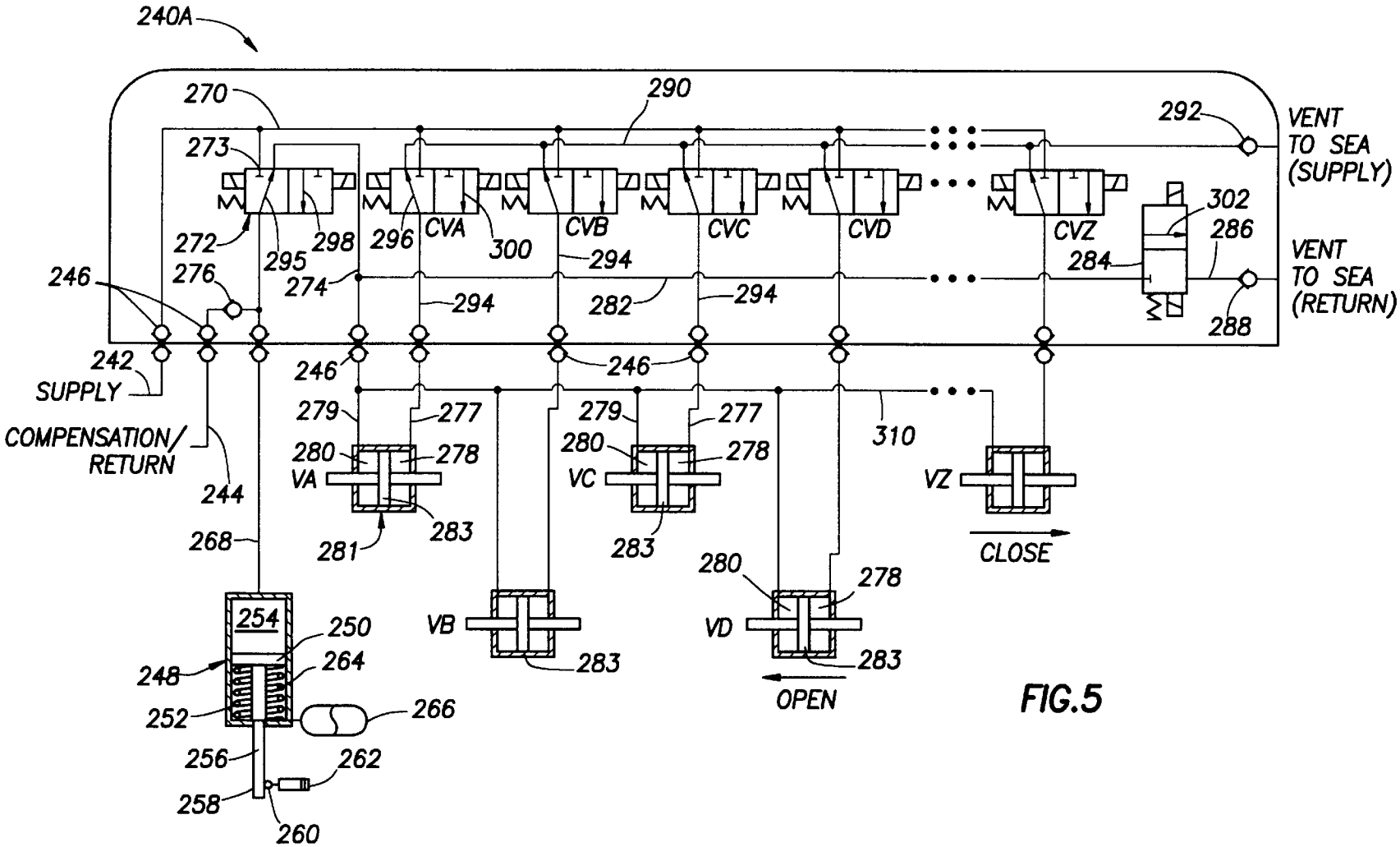
FIG. 5 is similar to FIG. 4 but is directed to a fail-safe closure system for a plurality of remote operable valve actuators, with actuator return pressure being provided by a single accumulator module under the control of a charging valve, a vent isolation valve, and supply control valves for individual valve actuators.

As shown in FIG. 1, a spring-returned type valve actuator mechanism is shown generally at 66 having an actuator cylinder 68 through which an actuator stem 70 extends. An actuator piston 72 fixed to actuator stem 70, is linearly moveable within the internal chamber of the actuator cylinder 68 and is sealed to the internal wall surface 74 of the cylinder so as to partition the internal chamber into a supply chamber 76 and a return chamber 78. The actuator stem 70 is connected to the gate member of a valve (not illustrated). A return spring 80 is positioned about the actuator cylinder with one end of the return spring being in force transmitting engagement with a flange 82 that is fixed to the actuator stem 70. Thus, upon venting of the supply chamber 76 and permitting fluid entry into return chamber 78, the force of the return spring or other urging means 80 will move the actuator stem 70 in a direction for movement of the gate of the valve to its predetermined, safe position.

Also shown in FIG. 1 is a control module as typically used for subsea well completion applications shown generally at 84 having a protective housing or mounting platform 86 including a plurality of conduit interface connectors or couplings 88 for connecting and permitting disconnection of actuator supply and return lines to internal valve-controlled lines and conduits of the module 84. The conduit couplings 88 permit the module 84 to be quickly and efficiently replaced in the event such should become necessary. Typically, the module 84 would be used in the subsea environment where its replacement as a unit is desirable. Fluid supply and return lines 90 and 92 are connected via the conduit interface couplers 88 to internal supply and return conduits 94 and 96. A vent line 98 is coupled with the internal return conduit 96 of the module to permit venting of fluid to the surrounding sea water or to another suitable receiver via a check valve 100. A control valve 102 of the module 84 is shown in its normal position with pressurized fluid from the supply being conducted via lines 90, 94 and 112 and control valve passage 104 to a fluid supply line 106 which feeds the supply side of the cylinder 68. In this position of the control valve 102, the return line 108 is connected by its coupler 88 with the return line 92, the internal return conduit 96, and vent line 98. In the valve position shown in FIG. 1, the return passage 110 of the control valve 102 is blocked. Solenoids 103 which may be remotely operated from a surface location are provided for actuation of control valve 102. When the control valve 102 is shifted to its safe mode, supply pressure is blocked and the internal supply conduit 112 is connected by valve passage 114 to the vent line 98 and to supply and return conduits 96 and 92. In this condition, the force of the return spring or other urging means 80 is operative to move the actuator stem 70 toward the process valve safe position by rerouting displaced fluid from the supply chamber 76 to the return chamber 78 through the control valve 102 so that the valve actuator mechanism can accomplish valve movement by the force of the return spring or other urging means. In the event the chambers 76 and 78 of the valve actuator cylinder are of different volumes, it may be desirable to provide volume compensating means, i.e., an accumulator, to ensure that complete valve closure can occur under the force of the compression spring or other urging means 80.

DESCRIPTION OF THE PREFERRED EMBODIMENTS OF THE INVENTION

Schematic Illustration of the Invention

Referring first to FIG. 2, a simplified, safe valve closure system is shown generally at 10 which is arranged for the safe closure of two valve and actuator assemblies shown generally at 12 and 14. For the purpose of simplicity, the valves are shown simply as gate members 16 and 18 which are linearly moveable relative to valve seats 20 and 22 of a valve body that is connected into a flowline or comprises a component of a process flow assembly such as a Christmas tree or manifold, for surface or subsea deployment. Each of the valve gate members 16, 18 is provided with an actuator stem 24, 26 which extends through a valve bonnet passage 28, 30 and through an actuator cylinder 32, 34. Piston members 36 and 38 are fixed to the respective actuator stems 24 and 26 and partition the respective internal chambers of the actuator cylinders 32, 34 so as to define supply chambers 40 and 42 and return chambers 44 and 46. For movement of the actuator stems 24, 26 to positions opening the valves as shown in FIG. 2, hydraulic or pneumatic pressure is supplied via supply lines 48 and 50 from one or more sources of pressurized hydraulic or pneumatic fluid. A single source S of hydraulic or pneumatic fluid pressure may be provided for operation of one or more valves to the open or process positions thereof as shown in FIG. 2. Unlike in the prior art actuator of FIG. 1, no spring return is provided for actuator 32 or 34.

The return chambers 44 and 46 of the valve actuators 32, 34 are connected by return lines 52 and 54 and a manifold conduit 56 to a variable volume internal chamber 58 of a fluid accumulator 60. The fluid within the chamber 58 of the accumulator is maintained under pressure by the force of urging means 62 being applied to a floating internal piston 64 which is moveable within an internal chamber of the accumulator and is sealed with respect to internal wall surfaces thereof. The urging means 62 may be a compression spring of one form or another as shown in FIG. 2, or in the alternative, may comprise any suitable, compressible fluid medium such as a nitrogen charge, compressed natural gas, compressed air, or even wellhead bore pressure being controlled by the subject valves, for example.

When it is desired for one or more of the valves 12 or 14 to be moved to the respective safe positions, the appropriate supply chamber 40, 42 of the valve actuator(s) are vented in any suitable manner to thus allow the piston 36, 38 to move and as a result displace supply fluid from the respective supply chamber 40, 42. When this occurs, the pressurized fluid within the accumulator chamber 58 will be driven via return lines 52, 54 and 56 to the respective return chambers 44 and 46 of the valve actuators at the urging of means 62. This pressurized fluid thereby forces the pistons 36, 38 and the valve stems 24, 26 to move in the valve closing direction.

Embodiment of FIG. 3

Referring now to FIG. 3, one embodiment of a fail-safe closure system of the present invention is shown with a control module generally at 120 in the schematic illustration and includes control valves 122 and 124 for controlling operation of a piston actuator 126 for valve operation and fail-safe positioning of a suitable process valve (not shown) connected to actuator 126. Piston actuator 126 has no substantial spring provided for its operation. Supply and compensation lines 128 and 130 and other fluid transfer lines are connected across conduit interface couplers 132 for modular coupling of the control module 120. The valves 122 and 124 are shown in their normal positions for opening actuator 126 with fluid supply line 128 being connected via valve passage 133 to a fluid supply line 134 that is connected to the supply chamber 136 of valve actuator 126. The return chamber 138 of the valve actuator is connected via a return line 140 and valve passage 142 via line 141 to a compensation branch line 144. Piston 139 separates chambers 136 and 138. A vent line 146 is connected to the compensation or return line 144 and permits venting of fluid from the return chamber 138 across a vent check valve 148 to the sea water or other atmosphere surrounding the valve and valve control module. Solenoids 147 which may be remotely operated from a surface location are provided for actuation of control valves 122 and 124.

An accumulator module shown generally at 150 includes a closed cylinder 152 having a floating piston 154 moveable therein under force developed by urging means 156 preferably embodied as a compression-type or similar mechanical spring. Another accumulator module may be provided for redundancy. Urging means 156 may also be any suitable compressible fluid medium that is located within the internal chamber 158 of the accumulator. Fluid within an accumulator fluid supply chamber 160 is pressurized by the force of the urging means 156 and is communicated to control valve 124 via an accumulator supply line 162. With the control valve 124 in its normal position as shown in FIG. 3, the accumulator supply line 162 is isolated from the return chamber 138 of the actuator. However, upon shifting of the valve 124 to its opposite, fail-safe mode, valve passage 164 communicates accumulator supply line 162 with the return line 140 of the valve actuator 126, thereby pressurizing the actuator chamber 138 with the fluid pressure from chamber 160 of the accumulator module 150. Since the control valve 122 is simultaneously shifted to its opposite or fail-safe mode, the internal valve passage 166 provides a flow path from the supply chamber 136 of the valve actuator 126 to the compensation line 130 and to the vent circuit comprising lines 144, 146 and vent valve 148.

Especially in the case of subsea valve control systems where electrically operated solenoid valves are utilized for control purposes, some redundancy must be provided to ensure fail-safe operation in the event one or more of the control valves fails to function. For example, in the event control valve 124 were to fail to shift to its fail-safe position (which is required to expose the back of the process operator piston to "boost pressure"), the associated process valve may not close because its only closing force would be that developed by process pressure acting on the cross sectional dimension of the valve stem such as illustrated in the schematic of FIG. 2. In this case, fluid pressure from a remote source, such as an associated drilling or production platform may be introduced via the compensation line 130 to apply pressure via valve passage 142 and return line 140 to the return chamber 138 of valve actuator 126. However, the fluid pressure will be effectively limited by the setting of check valve 148. For the valve actuator 126 to be shifted to its fail-safe position in this scenario, however, the supply chamber 136 must also be vented. This will occur if the control valve 122 shifts to its fail-safe position even if control valve 124 fails to shift.

If control valve 122 fails to shift (which is required to allow supply pressure to vent to the sea), but control valve 124 does shift, the process valve may only close if the supply line 128 is vented. If both control valves 122,124 fail to shift to their respective fail-safe modes, the only force acting to operate the process valve (assuming the supply line 128 is vented) is the wellhead bore pressure or pressure that is applied via the compensation line 130 as limited by the setting of the vent check valve 148.

Embodiment of FIG. 4

It is highly desirable that the fluid power of the accumulator be transferred to act on the actuator even upon loss of control (electric) signals simply by venting the supply pressure. It is therefore considered desirable to hold an "accumulator module" in loaded configuration using a solenoid operated latch mechanism or similar device. A system accomplishing these features for a single process valve is shown generally in FIG. 4 at 240 with a replaceable module 241 having conduit interface couplers 246 for connection to a fluid supply line 242, a compensation/return line 244, an accumulator supply line 268, a valve actuator supply line 277, and a valve actuator return line 279. The module 241 incorporates three control valves 272, 297 and 284, each being shown in their respective fail-safe positions and actuated by suitable remotely operable solenoids 299. An accumulator module 248 is provided having a fluid pressure chamber 254 being defined by an accumulator piston 250 that is moveable within the accumulator. The piston 250 is driven by an urging means, preferably a compression-type mechanical spring 252, but which may take other suitable forms such as a compressible gas. To compensate for volumetric changes in the internal chambers of accumulator module 248, a fluid storage accumulator balanced for ambient effects (i.e., a "sea chest") 266 is connected in fluid communication with the spring chamber 264 of the accumulator module housing. The accumulator piston 250 is adapted to be locked in its spring-loaded condition so that the fluid pressure within the chamber 254 will not influence operation of the valve actuator 281 until so desired. The piston 250 is provided with a locking stem 256 having a latch recess 258 or similar interface that is engaged by a latch device 262 which may be supported by the actuator housing or any other suitable means. Typically, the latch device 262 will be solenoid operated so that it may be retracted from its latched condition with the actuator locking stem 256 by applying a retracting signal to it. The latch device 262 will also be unlatched or moved to its fail-safe position as illustrated in FIG. 4 if electric power to the device is interrupted.

The control valves 272, 297 and 284 are shown in FIG. 4 in their fail-safe positions. In this configuration, the charging valve 272 exposes the return side or chamber 280 of the process valve actuator (VA) 281 to pressurized fluid from fluid chamber 254 of accumulator module 248 whenever the latch device 262 is released from stem 256. Fluid from fluid chamber 254 of accumulator module 248 cannot be exhausted to sea in this configuration of control valves because of the specific position of the vent isolation valve 284, thus ensuring that piston 283 of process valve actuator 281 is acted upon as desired. In order that fluid in fluid chamber 278 of process valve actuator 281 may be evacuated as required in order that piston 283 be allowed to move in response to pressure applied from chamber 280, control valve 297 is biased so that fluid may pass from fluid chamber 278, through lines 277 and 294, through control valve passage 296, and line 290 and out vent check valve 292 to the sea.

Prior to moving any process valve to its active position, it is essential that the accumulator module 248 be fully charged, fluid reservoir 254 filled, piston 250 retracted, and latch device 262 engaged to stem 256. To achieve this, charging valve 272 must be shifted to its alternative position so that supply fluid from line 242 may be routed by line 270 through passage 298, through line 268 and into fluid chamber 254. After accumulator module 248 is charged and latch device 262 engaged to stem 256, charging valve 272 is returned to the position shown in FIG. 4.

To operate process valve actuator 281, control valve 297 must be shifted to its alternative position which is opposite to that shown in FIG. 4. Simultaneously, the vent isolation valve 284 must also be shifted to its alternative position. With control valves 284 and 297 shifted from the position shown in FIG. 4, fluid supplied through lines 242 and 270 is routed through flow passage 300 and lines 294 and 277 into fluid chamber 278 of process valve actuator 281 to drive piston 283 and evacuate fluid from return fluid chamber 280 into line 279 and out vent check valve 288 via flow passage 302 and line 286. Fluid exhausted from chamber 280 cannot enter fluid chamber 254 of accumulator module 248 because piston 250 was previously fully compressed during the previously described accumulator module charging operation.

Returning the process valve actuator 281 to its fail-safe position simply involves allowing all of the control valves 272, 284, and 297 in module 241 and the latch device 262 to return to their respective fail-safe positions, as shown in FIG. 4.

Embodiment of FIG. 5

Referring now to FIG. 5, a control module is shown generally at 240A which is adapted for fail-safe control of a plurality of valve and valve actuator assemblies such as subsea wellhead valves and the like. The control module 240A shown in FIG. 5 is generally similar to the control module 240 shown in FIG. 4 except for additional valve and valve actuator assemblies VB–VZ similar to valve actuator 281 and control valves CVA–CVZ similar to control valve 297 for valve actuator assembly VA as shown in FIG. 4. Numerals similar to the numerals of FIG. 4 are shown in FIG. 5 for similar parts. As shown schematically in FIG. 5, a fluid supply line 242 and a compensation/return line 244 are connected to the internal circuitry of the control module via conduit interface couplers 246. An accumulator module 248 is provided having an internal piston 250 being urged by a compression-type mechanical spring 252 in a direction for pressurizing fluid within a variable volume internal fluid chamber 254. Urging means 252 may also be any suitable compressible fluid medium that is located within the internal chamber 264 of the accumulator. The accumulator piston 250 incorporates a locking stem 256 having a locking recess 258 or similar interface which is engaged by the latch detent 260 of a latch device 262. The latch device is remotely controllable, such as by solenoid control or by any other suitable means to secure the locking stem 256 and thus the piston 250 against movement within the housing of the accumulator module 248, until movement is selectively desired. When fluid is added to chamber 254 to compress urging means 252, fluid is displaced from chamber 264 into a fluid storage accumulator module or sea chest 266. The accumulator module 254 is selectively connected via a conduit 268 to a fluid manifold line 270 under the control of a charging valve 272 which, like other valve operator control valves, may conveniently take the form of a solenoid valve. In the normal position of the charging valve 272, pressurized fluid from the supply line 242 is isolated from the conduit 268 of accumulator module 248 as shown. The accumulator conduit 268 is in fluid communication through the charging valve 272 with a process valve vent line 274 and with the compensation/return line 244, being limited in one direction by a check valve 276. In its opposite position, the charging valve 272 when appropriately positioned communicates the supply manifold 270 with the fluid chamber 254 of accumulator module 248 and allows supply pressure to load accumulator 248 by forcing piston 250 downward as shown in FIG. 5, further compressing spring 252. The compensation/return line 244 can be used as a direct back up to accumulator module 248 to help close process valves through passage 295 of control valve 272.

The various process valve actuators of the system VA, VB, VC, VD, . . . VZ are each provided with respective solenoid operated control valves identified in FIG. 5 as CVA, CVB, CVC, CVD . . . CVZ. Each of these control valves is connected for fluid supply with the fluid manifold line 270 but, in the inactive normal positions thereof, the fluid supply of manifold line 270 is isolated from the respective valve closing chamber 278 of the respective process valve actuators VA–VZ. The opposite chambers 280 of valve actuators VA–VZ are connected to a vent manifold line 282 which is connected across a conduit interface coupler 246 to the inlet of a solenoid operated vent isolation valve 284. In the normal condition of the vent isolation valve 284, the vent manifold line 282 is isolated from a vent discharge line 286. When the vent isolation valve 284 is controllably shifted, fluid within any or all of the opening chambers 280 of the process valve actuators VA–VZ is vented via the vent manifold line 282 through the vent isolation valve 284 and vent discharge line 286 to the sea water or to a suitable receptacle. To ensure against invasion of sea water into vent manifold line 282 and vent isolation valve 284, a vent check valve 288 is provided in vent discharge line 286.

The individual control valves CVA–CVZ associated with respective valve actuators VA–VZ, can be individually or collectively controlled simply by operating the respective solenoid valve thereof from the position shown in FIG. 5 to the opposite position. In the position of the control valves CVA–CVZ shown in FIG. 5, each of the control valves CVA–CVZ is positioned so as to communicate the supply or "open" side 278 of each of the valve actuators VA–VZ with a supply vent manifold line 290 which is arranged to vent supply fluid to the sea across a check valve 292 which prevents backflow of sea water or other fluid in the supply vent manifold line. In the valve positions shown in FIG. 5, if the fluid chamber 254 of accumulator 248 is under pressure, this pressure will be communicated to the return side 280 of each of the valve actuators VA–VZ via the valve actuator line 274 and vent manifold line 310. Thus, when accumulator pressure is communicated to the return side of the valve actuators VA–VZ, the respective pistons 283 thereof will be moved in the process valve fail-safe direction, i.e. to the right as shown in FIG. 5. Normally, however, fluid chamber 254 may not be under pressure because the piston 250 is maintained in static position within the accumulator chamber 254 by virtue of the latch detent 260 being engaged with the piston locking stem 256. When the latch device 262 is actuated to retract its detent 260 from the locking stem recess 258, piston 250 will be released for movement under the force of the compression spring or other urging means 252. As piston 250 is moved by the spring force or other urging means, fluid pressure is increased within fluid chamber 254 of accumulator 248 and in the conduit 268 and through the charging valve 272 passage 295 via conduit 274 to the vent manifold lines 282 and 310. Thus, fluid pressure from chamber 254 of accumulator 248 is conducted to the return side 280 of each of the valve actuators, developing a force on pistons 283 thereof causing the valve actuators VA–VZ to move in the valve closing direction. As this occurs, fluid present within the supply side 278 of each of the valve actuators VA–VZ is displaced by the respective pistons 283 through respective supply lines 277, 294 and the control valve passages 296 to the supply vent manifold line 290. This displaced fluid is vented to the sea across the check valve 292 or, in the alternative, is vented to a suitable receptacle. If, for some reason, the volume of pressurized fluid within the chamber 254 is insufficient for adequate operation of all of the valve actuators, fluid under pressure can be introduced from a suitable source, such as an associated drilling or production platform or the like, via the compensation/return line 244, across the check valve 276 and into the accumulator conduit 268.

For charging the accumulator 248 with fluid under pressure, and thus compressing the spring or other urging means 252, the charging valve 272 is shifted to its opposite position thereby communicating the supply line 242 with the accumulator flowline 268 across the passage 298 of the charging valve. This can be done at any stage in the valve opening or closing procedure as well as when the valve actuators are being maintained in the process valve open position.

For valve opening, the control valves CVA–CVZ are selectively or collectively operated to the opposite position thereof shown in FIG. 5 so that the respective valve passage 300 is in communication with the supply manifold line 270 and with the actuator supply line 294, thus communicating supply pressure into the respective supply side 278 of the respective valve actuator. When this occurs, the return side 280 of each of the valve actuators will become pressurized by valve actuator piston force, thus pressurizing the vent manifold line 282, 310. Simultaneously, the vent isolation valve 284 will be shifted to its opposite position, communicating valve passage 302 with the vent line 286 and thereby causing displaced fluid from the return side chambers of the valve actuators across the check valve 288 and into the sea water surrounding the valve control system, thus moving the valve actuator mechanism and the associated valve to its predetermined "safe" position.

As described above, the fail-safe springless closure apparatus of FIGS. 4 and 5 are characterized by the following features:

(1) While the actuators or process valve closure devices are being moved to an open position, the accumulator circuit is venting, typically to the sea;

(2) When the actuators are fully opened, the accumulator circuit must be prevented from venting in order to prevent emptying of fluid from the accumulator 248 so as to preserve its capacity to later close the one or more actuators;

(3) The accumulator vent line isolating control valve (284) must "fail" in the shut-off or fail-safe position;

(4) In order to "charge" the accumulator (248) it is necessary to isolate all the actuators (VA, VB . . . ) by causing the charging control valve 272 to be in the active position opposite that shown in FIGS. 4 and 5;

(5) As with conventional Christmas Tree Control Systems, the compensation (return line which is routed back to the host facility/platform) can be pressurized in an emergency to provide supplementary fluid actuating pressure to assist in movement of process valve closure devices to their safe positions; and (6) The accumulator circuit vent line control valve 284 is brought to the active (fluid passing) position each time any actuator is caused to be put in the open position and is thereafter closed to optimize accumulator driving power.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A fail-safe closure apparatus for a process valve actuator, which includes a piston with an opening chamber on one side of the piston and a closing chamber on an opposite side of the piston, comprising:

a supply source of pressurized fluid for controlled application of pressurized fluid to said opening chamber;

an accumulator source of pressurized fluid for controlled application of pressurized fluid to said closing chamber;

a first control means including a first control valve having active and passive positions for directing pressurized fluid from said supply source to said opening chamber of said actuator when in said active position and for venting said opening chamber of said actuator when in said passive position; and a second control means including a second control valve having active and passive positions for preventing venting of pressurized fluid from said accumulator source and allowing accumulator pressurized fluid to be applied to said closing chamber of said actuator when in said passive position and for venting said closing chamber of said valve actuator when in said active position.

2. The fail-safe closure apparatus of claim 1 wherein, said process valve actuator is springless.

3. The fail-safe closure apparatus of claim 1 further comprising, a source of compensation pressure; and means for applying compensation pressure from said source of compensation pressure to said closing chamber of said valve actuator via said active position of said second control valve in the event that said second control valve is stuck in said active position.

4. The fail-safe closure apparatus of claim 1, wherein said accumulator source has a fluid pressure chamber, an accumulator piston and an urging device, and means for enabling said urging device and for disabling said urging device for prevention of urging of said piston against fluid in said pressure chamber when disabled, and said apparatus further comprising:

a third control means including a third control valve having an active position and a passive position for directing said supply source of pressurized fluid to said fluid pressure chamber in said accumulator source when in said active position and for connecting said fluid pressure chamber of said accumulator source to said second control means when in said passive position and when said urging device is enabled.

5. The fail-safe closure apparatus of claim 4 wherein, said means for enabling and disabling said urging device includes an electric actuator which disables said urging device so long as electric power applied to it and enables said urging device when electric power is not applied to it.

6. The fail-safe closure apparatus of claim 4 further comprising, a compensation path means in fluid communication with said third control means for applying compensation fluid to said closing chamber of said process valve actuator.

7. The fail-safe apparatus of claim 1 wherein, said first and second control means include a venting check valve.

8. The fail-safe apparatus of claim 4 wherein, said urging device is a spring.

9. The fail-safe apparatus of claim 4 wherein, said urging device is a compressed fluid medium.

10. A fail-safe closure arrangement comprising a process valve actuator (126) which includes a piston (139) with an opening chamber (136) on one side of the piston (139), and a closing chamber (138) on an opposite side of the piston (139), a fluid storage accumulator (150) having a cylinder (152), a piston (154) disposed in said cylinder, and an urging device (158) acting against said piston (154) for pressurizing fluid stored within said cylinder, a first control valve (122) having an active position (133) and a passive position (166), with an electrically operated solenoid (147) to shift said first control valve (122) to an active position (133) and with a spring to shift said first control valve (122) to said passive position when said solenoid is not energized;

a first fluid flow path (134, 135) between said first control valve (122) and said opening chamber (136) of said process valve actuator (126);

a supply of pressurized fluid (128);

a second flow path (129) connected between said supply of pressurized fluid (128) and said active position (133) of said first control valve (122);

a third flow path (143, 144) connected between said passive position (166) of said first control valve (122) and a vent conduit (146);

a second control valve (124) having an active position (142) and a passive position (164) with an electrically operated solenoid (147) to shift said second control valve to said active position and with a spring to shift said second control valve to said passive position when said solenoid is not energized;

a fourth flow path (140) connected between said closing chamber (138) and said second control valve (124);

a fifth flow path (141) connected between said second control valve (124) and a vent conduit (146);

a sixth flow path (162) connected between said chamber (160) of said accumulator (150) and said second control valve (124);

wherein when said first (122) and second (124) control valves are energized to said active positions by their respective solenoids, and where (a) pressurized fluid is applied from said supply of pressurized fluid (128) via said second flow path (129) and said active position (133) of said first control valve (122) and said first fluid flow path (134, 135) to said opening chamber (136) of said process valve actuator (126), and (b) said closing chamber (138) of said process valve actuator (126) is vented via said fourth flow path (140), said opening position (142) of said second control valve (124) and said fifth flow path (141) and said third flow path (143, 144, 146), whereby said valve actuator (126) moves to said active position, and when said first (122) and second (124) control valves are not energized by their respective solenoids and are moved to their respective passive positions (166, 164), (c) said opening chamber (136) of said actuator (126) is vented via said first flow path (135, 134), said closing position (166) of said first control valve (122) and said third flow path (143, 144, 146), and (d) said closing chamber (138) of said actuator (126) is connected to pressurized fluid of said accumulator chamber (160) via said sixth flow path (162), said closing position (164) of said second control valve (124) and said fourth flow path (140), whereby said valve actuator (126) automatically moves to said passive position where electrical power is lost to said first and second control valve solenoids.

11. The fail-safe closure arrangement of claim 10 further comprising:

a seventh fluid flow path (130, 144, 141) connected to said active position (142) of said second control valve (124), whereby fluid pressure from a remote source is capable of being selectively applied via said seventh fluid flow path in the event that said second control valve (124) were to stick in said active position, whereby higher pressure may be applied to said process valve actuator closing chamber (138) than applied to said opening chamber (136) from said source of pressurized fluid (128), with said source of pressurized fluid (128) being vented.

12. The arrangement of claim 10 wherein, said valve actuator is springless.

13. A fail-safe closure arrangement comprising:

a process valve actuator (281) for movement of an associated valve member to a predetermined safe position, the valve actuator (281) including a piston (283) with an opening chamber (278) for opening said actuator on one side of said piston (283) and a closing chamber (280) on an opposite side of the piston (283), a first control valve (297) having an active position (300) which is actuatable by an electric solenoid and having a passive position (296), said first control valve (297) having means for returning said first control valve to said passive position upon loss of electric power to said electric solenoid of said first control valve;

a first fluid flow path (277, 294) between said first control valve (297) and said opening chamber (278) of said process valve actuator (281);

a fluid accumulator (248) having an actuator piston (250) in an accumulator chamber (254) having fluid stored therein, said accumulator (248) including a latched urging device (264) which is maintained in a loaded position by an electric latch (260, 262) which when energized prevents said urging device (264) from moving said actuator piston (250), and upon loss of electric power thereto causes said urging device (264) to be unlatched and to drive said piston (250) against said fluid stored therein and causing said fluid to be pressurized;

a second fluid flow path (268, 295, 274, 279) from said accumulator chamber (254) of said accumulator (248) to said closing chamber (280) of said valve actuator (281);

a source of pressurized supply fluid (242);

a third fluid flow path (242, 270) from said source of pressurized supply fluid to said first control valve (297);

a fourth fluid path (290) from said first control valve (297) to a first vent line;

a second control valve (284) having an active position (302) which is actuatable by an electric solenoid (299) and having a passive position (293), said second control valve (284) having means for returning said second control valve (284) to said passive position upon loss of electric power to said electric solenoid of said second control valve (284);

a fifth fluid flow path (282) connected for fluid communication between said second fluid flow path (274, 279) and said second control valve (284); and a sixth fluid flow path (286) from said second control valve (284) to a second vent line;

wherein when electric power is applied to said solenoids of said first and second control valves and to said accumulator electric latch, (a) said fluid accumulator (248) is latched and pressurized fluid is not present in said second fluid flow path (268, 295, 274, 279);

(b) said active position of said first control valve (297) connects pressurized supply fluid to said opening chamber (278) of said process valve actuator (281) from said third fluid flow path to said first fluid flow path; and (c) said closing chamber (280) of said process valve actuator (281) is connected to said second vent via a fluid flow path to said second control valve (284) in the active position (302) and via said sixth fluid flow path (286), and wherein when electric power is lost;

(d) said urging device becomes unlatched and pressurized fluid from said fluid accumulator (248) is applied via said second fluid flow path to said closing chamber (280) of said process valve actuator (281);

(e) said first control valve (297) shifts to its passive position and said opening chamber (278) of said valve actuator (281) is connected to said first vent via said first flow path (277, 294, 290) and said passive position (296) of said first control valve (297); and (f) said fifth flow path (282) is disconnected from said sixth flow path (286) to said second vent by the closing position (293) of said second control valve (284).

14. The fail-safe closure arrangement of claim 13 further comprising:

a plurality of substantially identically arranged and designed first control valves (CVB, CVC . . . ) each one uniquely associated with a respective one of a plurality of process valve actuators (VB, VC . . . ) wherein:

a respective first fluid path (294, 277) is connected between each of said first control valves (CVB, CVC, . . . ) and an opening chamber (278) of a respective process valve actuator (281);

said second flow path (268, 295, 274, 279) is further connected from said accumulator chamber (254) of said accumulator (248) to a closing chamber (280) of each respective valve actuator;

said third fluid flow path (242, 270) from said source of pressurized supply fluid is further connected to said plurality of first control valves (CVB, CVC . . . ), and said fourth fluid flow path (290) to said first vent is further connected to each of said plurality of first control valves wherein:

upon loss of electric power, each of said first control valves returns to its passive position, said closing chamber of each of said plurality of process valve actuators is connected via said second flow path to said pressurized fluid stored in said fluid accumulator (248), and said opening chamber of each of said plurality of process valve actuators is connected to said first vent via said respective first fluid flow paths (277, 294) and said passive position of a respective first control valve (CVB, CVC . . . ) to said fourth fluid flow path (290).

15. The fail-safe closure arrangement of claim 13 further comprising:

a charging control valve (272) having an active position (298) for charging accumulator (248) and a passive position (295);

said charging control valve (272) being connected to said third flow path (242, 270) to said supply of pressurized fluid, and completing said second fluid flow path from said accumulator chamber (254) of said accumulator (248) to said closing chamber (280) of said process actuator (281), wherein in said active position (298) of said charging control valve (272), said supply of pressurized fluid (242) is connected to said accumulator chamber (254) of said accumulator (248).

16. The fail-safe closure arrangement of claim 13 wherein said valve actuator (281) is springless.

* * * * *